United States Patent [19]

Webster

[11] Patent Number: 4,531,575

[45] Date of Patent: Jul. 30, 1985

[54] RADIATORS

[75] Inventor: Dennis M. Webster, Kingston-upon-Hull, England

[73] Assignee: Myson Group Limited, Ongar, England

[21] Appl. No.: 294,189

[22] Filed: Aug. 19, 1981

[30] Foreign Application Priority Data

Aug. 22, 1980 [GB] United Kingdom ..... 8027339

[51] Int. Cl.[3] ..... F28F 7/00

[52] U.S. Cl. ..... 165/78; 16/2; 285/162/192

[58] Field of Search ..... 237/70; 165/130, 76, 165/78; 16/2; 285/162, 192, 321, DIG. 22

[56] References Cited

U.S. PATENT DOCUMENTS

| | | | |
|---|---|---|---|
| 1,718,010 | 6/1929 | Stanhope | 237/70 |
| 2,904,315 | 9/1959 | Pennella | 165/78 |
| 3,065,004 | 11/1962 | Laich | 16/2 |
| 4,232,421 | 11/1980 | Tucker | 16/2 |
| 4,286,506 | 9/1981 | Yanagida | 98/2 |

FOREIGN PATENT DOCUMENTS

| | | | |
|---|---|---|---|
| 818748 | 8/1974 | Belgium . | |
| 2049895 | 4/1972 | Fed. Rep. of Germany . | |
| 2429321 | 1/1975 | Fed. Rep. of Germany . | |
| 2659582 | 6/1978 | Fed. Rep. of Germany | 237/70 |
| 2659669 | 6/1978 | Fed. Rep. of Germany | 237/70 |
| 2850422 | 5/1980 | Fed. Rep. of Germany . | |
| 1558366 | 2/1969 | France . | |
| 2249299 | 5/1975 | France . | |
| 2263449 | 10/1975 | France . | |
| 134718 | 10/1972 | Norway . | |
| 578706 | 8/1976 | Switzerland . | |
| 1475376 | 6/1977 | United Kingdom . | |

*Primary Examiner*—Henry Bennett

*Attorney, Agent, or Firm*—Watson, Cole Grindle & Watson

[57] ABSTRACT

A heat-exchange radiator (1) is connected to a fluid flow circuit by a connector (19) which provides one member (21) of an interengageable spigot and socket pair (21 and 25) for push-fit, fluid-tight, engagement between the connector and the radiator, with latching formations (22 and 27) at least one of which is resilient. Preferably the connector carries the spigot which tapers and engages with a socket of corresponding shape, the spigot carrying an O-ring seal (23) and either latching fingers (42) or a resilient latching circlip (22).

8 Claims, 4 Drawing Figures

RADIATORS

BACKGROUND OF THE INVENTION

1. Field of the Invention

The present invention relates to improvements in heat exchange radiators and more particularly but not exclusively to a connector for forming a connection between a pipe fitting and a radiator panel.

2. Description of the Prior Art

A known panel radiator for room heating comprises a pair of super-imposed preformed metal sheets having water manifolds extending lengthwise of the sheets near two opposed edge regions and transverse ducts interconnecting the manifolds. The preformed sheets are welded together by an automated welding process, usually resistance welding. The manifolds extend up to the longitudinal ends of the radiator and each end of the two manifolds is closed by a respective end plate which is manually welded in position. The end plate has a threaded hole formed therein for receiving threaded pipe fittings. A radiator of this type is referred to as a "single panel radiator with end connections".

Double panel radiators having "end connections" are also known. A double panel radiator has two panels which are fixed together in parallel spaced apart relationship and, unlike the single panel radiator described above, a recess is formed in each manifold on adjacent areas of the inner, facing surfaces of the panels. Each recess extends inwardly from the longitudinal end of the panel and a connecting web of U-shaped cross-section is welded between the two panels at the periphery of the two opposed recesses. An end plate having a threaded bore formed therein is welded to the two free edges of the connection web and the manifolds to close the end of the radiator, provide a fluid connection between the two radiator panels and form the end connection.

A double or single panel radiator having end connections of this type suffers from the disadvantage that skilled manual labor is required to fit the end plates by welding and these welds may be prone to leakage.

Another known panel radiator includes a pair of preformed metal sheets also having manifolds extending lengthwise of the sheets and transverse ducts interconnecting the manifolds. The manifolds are swaged together at the transverse edges of the sheets and the sheets are welded together by a machine along the longitudinal and transverse edges. A bore is formed in the manifold wall at a distance inset from the edge of the radiator and a connector is welded onto the radiator to surround this bore. A radiator of this type is referred to as a back connection radiator because the connection is at the back of the radiator rather than on the end.

In the known arrangement the connector is projection welded into position and this requires the provision of a back up ring, having passageways in its circumference, which is positioned inside the manifold between the front and rear walls so as to surround the bore.

Projection welding has the advantage that reliable welds are produced but has the disadvantage that it requires expensive capital equipment. In addition the back up ring is redundant once welding is completed and thus constitutes an additional expense of manufacture.

Double panel back connection radiators are also known and these include two single panel radiators which are connected together by projection welding a T-shaped connection between the manifolds of the two radiator panels at or near two of the corners of the radiator. A double panel radiator having this construction suffers from the same disadvantage of a single radiator with projection welded back connection.

In another known radiator a pair of aligned bores are formed in the manifold walls and two flanged cylindrical brass components, constituting a so-called banjo connection, are inserted into the respective bores and screw threadingly interconnected with one another. A rubber sealing ring is disposed between the flange of each component and the respective manifold wall to prevent fluid leakage. Connections of this type have the advantage that they require no welding but they have the disadvantage that being turned parts they are expensive to produce. In addition the connection is visible from the front of the radiator which is undesirable aesthetically.

SUMMARY OF THE INVENTION

It is an aim of the present invention to avoid or at least ameliorate the above-mentioned disadvantages.

According to the present invention there is provided in combination, a connector having a first end formation adapted to co-operate with a fluid flow circuit component and a second end formation including one member of an interengageable spigot and socket pair, and a heat-exchange radiator which includes the other member of the spigot and socket pair. The connector and the radiator are connectible by push-fit, fluid-tight, engagement of the connector and the radiator. Cooperating latching formations are provided on the connector and the radiator, at least one of which latching formations is resilient.

One example of the fluid flow circuit component is a pipe, another is a fluid flow control valve and a third is an air-bleed valve. The connector is adapted to be connected to any one or more of these exemplary components or to some other component of the circuit, such as an end plug. In a preferred embodiment the member of the spigot and socket pair defined by the panel is a swaged socket in the manifold wall, having walls which converge in a direction towards the interior of the radiator. The spigot on the connector naturally has a corresponding tapered configuration.

In one embodiment the securing latching engagement device includes a resilient clip, preferably a circlip, received in a groove formed in the spigot and which is disposed within the radiator and in engagement with the end face of the wall of the swaged hole.

To ensure a fluid-tight fit between the panel and the connector there may be provided a seal in the form of a resilient ring of plastics material. This may be received in a groove formed in the spigot for sealing engagement with the spigot and the socket. The sealing means can be an O-ring seal. As an alternative or in addition, a seal may be provided between the connector and the wall of the manifold external of the spigot and socket pair.

Where the radiator is a panel radiator, the connection is preferably of the so-called back connection type and the connector may be a hot, non-ferrous forging.

In a further preferred embodiment of the invention a connector for use in providing a double panel radiator has two of the second end formations which engage with respective formations on the two panels which form the double panel radiator. Thus, the connectors serve as fluid connections between the two panels.

These last-mentioned connections preferably have a T-shaped configuration with a pair of tapered spigots each of which carries a circlip and co-operates with a respective swaged socket formed in respective panels of the double panel radiator.

BRIEF DESCRIPTION OF THE DRAWINGS

For a better understanding of the present invention preferred embodiments thereof will now be described, by way of example only, with reference to the accompanying drawings, in which.

DETAILED DESCRIPTION OF THE PREFERRED EMBODIMENTS

Figure 1:
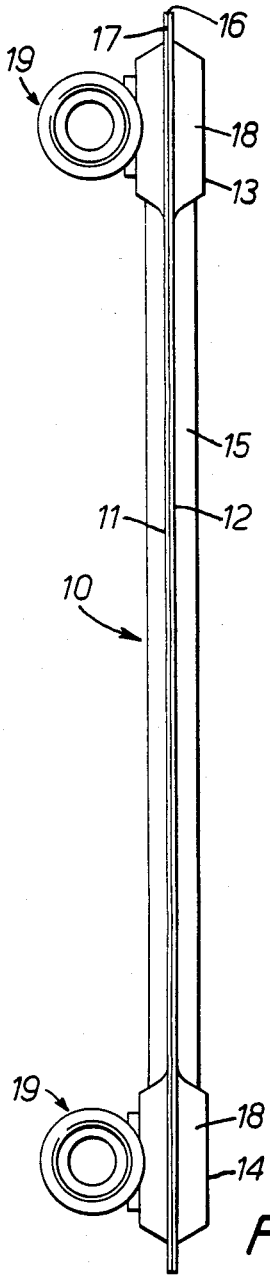
FIG. 1 is an end view of a single panel radiator with two connectors in accordance with the invention.
Figure 2:
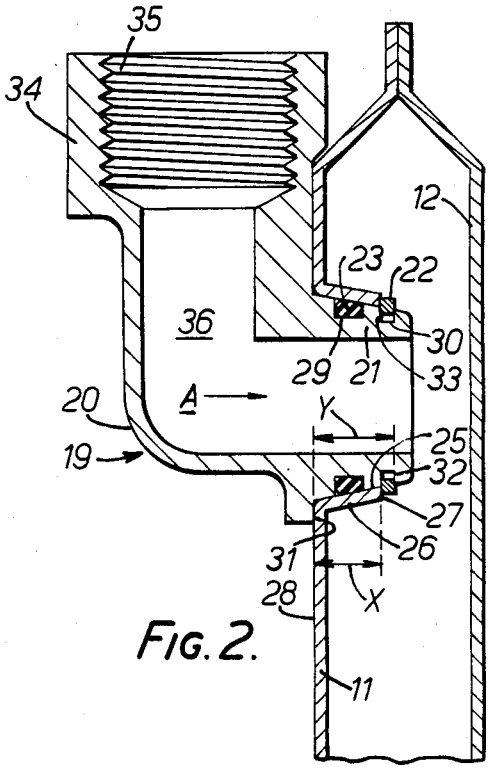
FIG. 2 is a cross-section plan view of the connector of FIG. 1 drawn to a larger scale.

Referring to the embodiment of FIGS. 1 and 2 there is shown a single panel radiator generally indicated as 10 having a pair of preformed metal shells including a rear shell 11 and a front shell 12 which together define manifolds 13 and 14 near to the edge regions of the shells and extending longitudinally of the shells, and a plurality of transverse ducts 15 interconnecting the manifolds. The shells are machine welded together along their longitudinal edges 16 and transverse edges 17 by a resistance seam welding process and, where the shells abut one another between the transverse ducts 15, the shells are spot welded together. As will be seen from the drawing, each end 18 of the manifolds 13 and 14 is swaged together so as to form the continuous transverse edge 17.

The radiator panel is provided with four connectors, only two of which, identified generally by reference 19, are visible in FIG. 1. The connectors are disposed adjacent to the four corners of the radiator and these permit pipe fittings and the like to be connected to the radiator. In one example (not shown), an air-bleed valve is fitted to one of the top two connections, a plug to the other top connection, a "lockshield" valve to one of the bottom two connections and a manually adjustable flow control valve to the other bottom connection. Connectors which incorporate one or more of those functions, as well as universal connectors for accommodating any one of them or a fluid flow conduit, are all in accordance with the invention. Where a fluid flow valve is included in the connector it is conveniently a ball valve. The illustrated back connections are by way of ports in the rear radiator shell 11, each of which emerges into one of the manifolds 13 and 14 at a position near the edge of the radiator panel. The construction of the connector will now be described more fully with reference to FIG. 2 of the drawings.

Each connector 19 is formed by a body member 20, provided with a spigot 21 which carries a retaining clip 22 and an O-ring seal 23 in an annular recess in the exterior surface of the spigot. The socket with which the spigot co-operates is a bore 25 formed in the rear shell 11. The bore 25 is formed into a port by swaging during the manufacture of the rear radiator shell. The bore 25 has a wall 26 which extends inwardly toward the interior of the manifold and which converges in a direction toward the interior of the manifold. The position of an end face 27 of the wall 26 is accurately controlled during the manufacturing process such that distance X between the end face 27 and the exterior face 28 of the wall of the manifold is accurately controlled.

The spigot 21 has a tapered configuration which matches accurately the taper of the swaged hole 25. A first annular groove 29 accommodates the O-ring seal 23 and a second annular groove 30 accommodates the retaining clip 22 which is a C-shaped circlip. A shoulder 31 is present at the boundary between the spigot 21 and the remainder of the body member 20 and, when the connector and panel combination is assembled, the shoulder 31 abuts the exterior wall 28 of the manifold. The distance Y between the shoulder 31 and that edge 32 of the second annular groove 30 which is further from the shoulder 31 is dimensioned so as to be greater than the distance X by the thickness of the clip 22, and the clip is a snug fit in the groove 30 between the groove 32 and an opposite edge 33.

On assembly, the resilient ring 23 and the circlip 22 are positioned in their respective grooves 30 and 29 and the spigot is introduced into the socket 25 in the direction of the arrow A. The converging walls of the socket 25 compress the circlip 22 and the moment of contact of the shoulder 31 with the surface 28 is such that it allows insertion of the spigot 21 into the socket 25, with the edge 33 of the groove 30 pushing the circlip 22 deeper into the socket 25, just to the extent that the circlip 22 emerges at the end face 27 of the socket 25, upon which emergence, the circlip 22 relaxes from its compressed condition and thus returns to its uncompressed dimensions. The enlarged circlip thus abuts the end face 27 and, because the circlip 22 is a snug fit in the groove 30, any withdrawal of the spigot from within the socket is prevented. Contact of the O-ring seal 23 with both the spigot 21 and the socket 25 maintains a fluid-tight connection. The degree of compression of the O-ring is fixed, movement of the spigot in and out of the socket being prevented on the one hand by contact of the shoulder 31 and surface 28 and, on the other hand, by contact of the circlip 22, surface 27 and groove edge 32.

In the arrangement illustrated, the retaining ring is located inside the manifold and it is therefore not readily possible to gain access to the retaining ring and so removal of the body member is not a practical possibility.

As shown in FIG. 2, the body member 20 has an end formation 34 which is provided with a threaded bore 35 for receiving pipe fittings and the like. In the arrangement illustrated, the connector has a fluid flow passage 36 which comprises two flow passage portions which intersect at right angles, but any other convenient arrangement may be used.

A "back connection" as illustrated in FIGS. 1 and 2 has the advantage that it is easily formed by the action of push-fit latching engagement of the connector with the radiator panel, at any time after the pair of preformed shells have been welded together, and without the need for manual welding. This contrasts with the case of the known "end connections" and avoids the capital expense of projection welding associated with the known back connection. The connection of the invention has the additional advantage that, even after the connection is made, the connector can, with suitable design of the body member 20, freely be rotated to any convenient angle.

It may be convenient to make the connections between the panel and the connectors before the radiator is degreased and stove enamelled. With enamelling at a temperature of approximately 120° C. it has been found that a seal 23 of nitryl rubber is able to withstand these operations. Although the body member 20 is preferably a hot forging, which may be a ferrous or non-ferrous material, the body member can be moulded from a plastics material.

Figure 3:
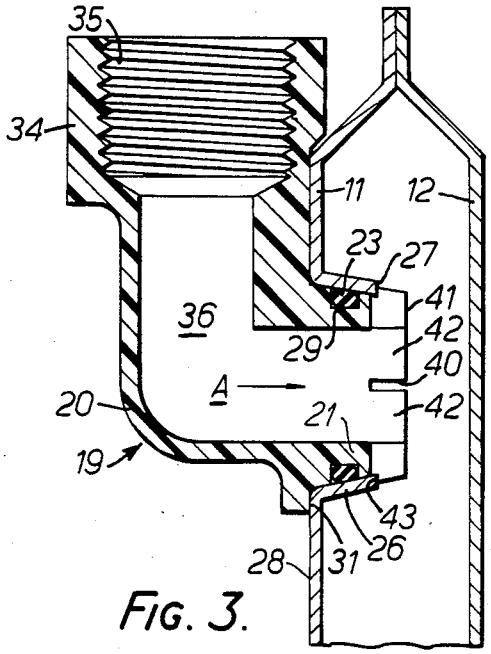
FIG. 3 is a cross-sectional plan view similar to that of FIG. 2 of a second embodiment of connector.

In the alternative embodiment illustrated in FIG. 3, a pipe connection for a single panel radiator is shown which is similar to that of FIGS. 1 or 2 but is made of a resilient plastics material. Like reference numerals have been used to denote like parts. The spigot 21 has four equally spaced slots 40 which extend axially of the spigot inwardly from its end face 41 to define four fingers 42 at the free end of the spigot. The free end of the spigot is provided, on the external face of each of the fingers, with a latching lip surface 43. The slots are wide enough to permit the spigot end to be compressed when the spigot is pushed into the socket, and the spigot is resilient so that the fingers 42 spring out and the lip surfaces 43 spring over the socket end surface 27 when the spigot is pushed into the socket 25 far enough to bring the shoulder 31 into contact with the external surface 28 of the radiator panel. Again, the connector is freely rotatable in the socket 25 provided the body member 20 is so designed as not to foul the rear shell 11 of the radiator panel when the connector rotates.

Figure 4:
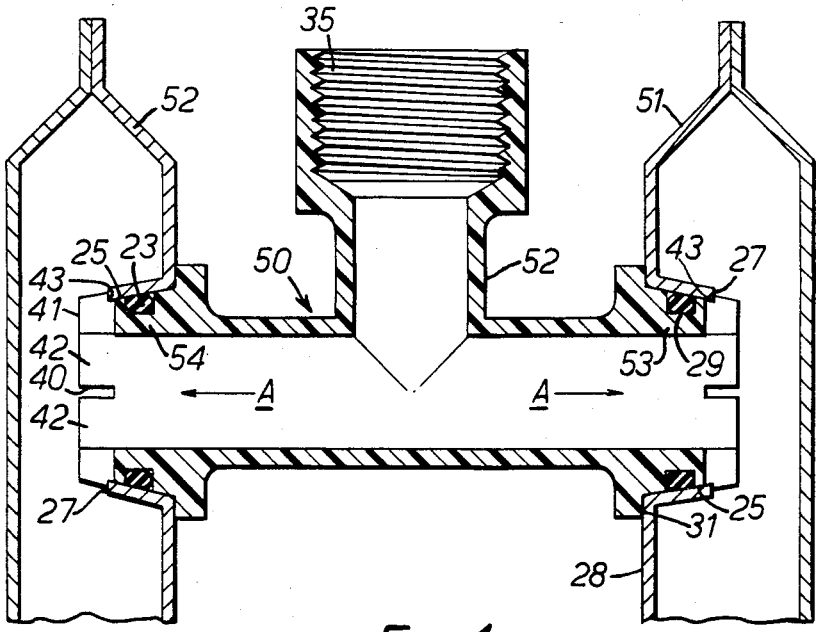
FIG. 4 is a cross-sectional view of a third embodiment of connector and a fragment of a double panel radiator of which the connector is a part.

A further embodiment of the invention will now be described with reference to FIG. 4 which illustrates a connector 50 for a double panel radiator. The double panel radiator includes two single panel radiator panels 51 and 52 mounted back to back. As in the above-described case of a single panel radiator each double panel radiator is provided with four connections disposed at the corners of the radiator and for a double radiator these are conveniently located between the two single panels. FIG. 4 illustrates one such connection. It includes a T-shaped body member 52 which has a central threaded bore 35 and two like spigots 53 and 54 of tapered configuration which are received in converging bores 25 formed in the manifolds of the two radiator panels 51 and 52. The single radiator panels making up the double radiator are identical in construction the single panel radiator described above and like reference numerals are used to describe features thereof. Each spigot 53 and 54 is of identical construction to that of FIG. 3 and like reference numerals are used to describe features thereof.

Naturally, the construction of FIG. 2 may be applied to the construction of double panel radiators as in FIG. 4.

The invention has the advantage that the single panels which form a double panel radiator can be of identical construction to one another and to the panel of a single panel radiator. By contrast, in the known double panel radiators having "end connections" the single panels required for making up the double panel have first to be modified. The double panel radiator also has the above-stated advantages of the single panel radiator, namely quick mechanical assembly without welding and the possibility of adjustment of the angle of the connection.

The invention may be applied to panel radiators having more than two panels and may also be applied to convector radiators.

One further advantage of the invention is the possibility of deferring final assembly of the connectors and the radiator until after delivery to the contractor or plumber. Radiator panels without the body members attached would occupy less space in transit and single or double panel radiators may be made up by the contractor on site by utilizing connectors as described above. As mentioned above, the connectors could incorporate air-bleed valves, end plugs, lockshield valves or flow control valves, with further saving in installation costs.

Finally, the said first end formation of the connector can be provided as an end formation identical or corresponding to said second end formation, so that the connector can provide nothing more than a simple connection between the two panels of a double panel radiator.

Obviously, numerous modifications and variations of the present invention are possible in light of the above teachings. It is therefore to be understood that within the scope of the appended claims, the invention may be practiced otherwise than as specifically described herein.

I claim:

1. A connector assembly for connecting a fluid flow circuit component to at least one back connection heat exchange radiator, said radiator comprising a panel formed of first and second superimposed preformed metal sheets, said first sheet defining a socket member, and wherein said connector assembly comprises:

a connector having a first end formation adapted to cooperate with said fluid flow circuit component, and a second end formation comprising a first spigot member interengageable with said socket member;

first resilient latching means providing on said spigot member including a first latching surface defining an incomplete annulus on said spigot member, said annulus having at least one gap between portions of said first latching surface; and second latching means including a second latching surface provided on said socket member for cooperating with said first resilient latching means, such that said connector and said panel of said radiator are connectable via an inward push-fit, fluid tight latching engagement of said first latching surface on said spigot member with said second latching surface of said socket member during which said first latching means deforms resiliently as said first latching surface is pushed past said second latching surface, and then releases resilient after said first latching surface has engaged said second latching surface, said resilient deformation causing said at least one gap to narrow and said resilient releasing causing said gap to widen towards its original width.

2. The connector assembly of claim 1, wherein said connector further comprises a shoulder stop surface portion for contacting an exterior surface portion of said first metal sheet so as to limit further inward movement of said spigot member relative to said socket member beyond a point at which said latching engagement occurs.

3. The connector assembly of claim 1, wherein said connector comprises a hot metal forged connector.

4. The connector assembly of claim 1, wherein said connector comprises a plastic molded connector.

5. The connector assembly of claim 1, wherein said at least one back connection heat exchanger radiator comprises first and second back connection heat exchanger radiators and wherein said connector comprises a third end formation comprising a second spigot member engageable with said second back connection heat exchanger radiator.

6. The connector assembly of claim 1, wherein said connector comprises a body portion for accommodating a fluid flow control device.

7. The connector assembly of claim 1, wherein said spigot member has an annular recess in an external surface thereof, and a retaining clip comprising an incomplete ring received in said recess, said clip including said first latching surface.

8. The connector assembly of claim 1, wherein said spigot member has a shoulder on the external surface thereof defining said first latching surface, and said spigot member has coaxial through slots in the wall thereof, said slots extending from the free end of said spigot member to beyond said shoulder.

* * * * *